US011708723B2

(12) United States Patent
Gordon et al.

(10) Patent No.: US 11,708,723 B2
(45) **Date of Patent: *Jul. 25, 2023**

(54) GUIDE FOR TOP DRIVE UNIT

(71) Applicant: Gordon Bros. Supply, Inc, Stroud, OK (US)

(72) Inventors: Robert L. Gordon, Stroud, OK (US); Ronald K. Gillespie, Stroud, OK (US); David L. Williams, Davenport, OK (US); James T. Grammer, Stroud, OK (US); Bobby D. Fisk, Wellston, OK (US); Charles W. Harjo, Stroud, OK (US)

(73) Assignee: Gordon Bros. Supply, Inc., Stroud, OK (US)

( * ) Notice: Subject to any disclaimer, the term of this patent is extended or adjusted under 35 U.S.C. 154(b) by 192 days.

This patent is subject to a terminal disclaimer.

(21) Appl. No.: 17/151,295

(22) Filed: Jan. 18, 2021

(65) Prior Publication Data

US 2021/0140238 A1 May 13, 2021

Related U.S. Application Data

(63) Continuation of application No. 16/507,895, filed on Jul. 10, 2019, now Pat. No. 10,895,111.

(51) Int. Cl.

| | |
|---|---|
| ***E21B 3/02*** | (2006.01) |
| ***E21B 19/24*** | (2006.01) |
| ***E21B 15/00*** | (2006.01) |
| ***E21B 1/00*** | (2006.01) |

(52) U.S. Cl.

CPC ..... *E21B 3/02* (2013.01); *E21B 19/24* (2013.01)

(58) Field of Classification Search

None

See application file for complete search history.

(56) References Cited

U.S. PATENT DOCUMENTS

| | | | | |
|---|---|---|---|---|
| 2,046,323 A | | 7/1936 | Wolfe | |
| 3,718,266 A | * | 2/1973 | Donnally | E21B 33/064 414/22.71 |
| 5,381,867 A | | 1/1995 | Berry | |
| 5,433,279 A | | 7/1995 | Tessari et al. | |

(Continued)

OTHER PUBLICATIONS

International Search Report and Written Opinion (PCT/US2020/041585); dated Sep. 14, 2020.

*Primary Examiner* — Matthew Troutman
*Assistant Examiner* — Douglas S Wood
(74) *Attorney, Agent, or Firm* — Dunlap Codding, P.C.

(57) ABSTRACT

A method for forming a guide for a top drive unit includes connecting a lower track member to a lower mast section and connecting an upper track member to an upper mast section and telescoped with the lower track section. A slider is slidably positioned about the upper track member so the slider is movable along the upper track member. The slider has a lateral cross-sectional profile substantially the same size and shape as a lateral cross-sectional profile of the lower track member. The skate is slidably positioned about the lower track member to be movable along the lower track member and onto the slider. The skate travels along the upper track member via the slider. The skate is connectable to a top drive unit so the top drive unit is movable along the lower track member and the upper track member.

10 Claims, 12 Drawing Sheets

(56) References Cited

U.S. PATENT DOCUMENTS

| | | | | |
|---|---|---|---|---|
| 5,433,289 | A * | 7/1995 | O'Rourke | A62B 35/0031 182/6 |
| 5,501,286 | A | 3/1996 | Berry | |
| 6,024,181 | A | 2/2000 | Richardson et al. | |
| 6,199,641 | B1 * | 3/2001 | Downie | E21B 19/10 173/55 |
| 6,951,082 | B2 | 10/2005 | Nelson et al. | |
| 7,828,086 | B2 | 11/2010 | Lesko | |
| 8,646,240 | B1 * | 2/2014 | Patrick | E21B 7/023 52/114 |
| 8,893,825 | B1 | 11/2014 | Akerman | |
| 9,074,421 | B2 | 7/2015 | Marica et al. | |
| 10,895,111 | B1 * | 1/2021 | Gordon | E21B 7/023 |
| 2009/0314547 | A1 | 12/2009 | Stoetzer et al. | |
| 2013/0180702 | A1 | 7/2013 | Wiedmer et al. | |
| 2014/0138081 | A1 | 5/2014 | Yorga et al. | |
| 2016/0251906 | A1 | 9/2016 | Borra | |
| 2018/0179834 | A1 | 6/2018 | Gordon et al. | |

* cited by examiner

GUIDE FOR TOP DRIVE UNIT

CROSS-REFERENCE TO RELATED APPLICATIONS

This application is a continuation of U.S. Ser. No. 16/507,895, filed on Jul. 10, 2019; the entire contents of which is hereby expressly incorporated herein by reference.

BACKGROUND

A top drive unit is used to rotate a drill string from the top of the drill string. The top drive unit generally includes a motor and a gear system. The motor is coupled to the gear system, and the gear system is connected to a short pipe, which is in turn attachable to the top of the drill string. The top drive unit is suspended on a hook at the end of a traveling block. The traveling block is suspended by cables from the top of a mast of a drilling rig or workover rig. The traveling block moves up and down the mast with the cables, and the top drive unit moves with the traveling block.

When the top drives rotate the drill string, torque generated by the top drive unit must be transmitted to the mast and supporting structure. For this purpose, it is conventional to provide a guide or torque carrier running the length of the mast along which the top drive unit travels. Larger rigs have upper and lower mast sections that telescope relative to one another so the mast is movable between a retracted position for transport and an extended position for well operations. When these telescoping rigs are assembled on the well site, the guides must be mounted to the mast after the mast has been moved to the extended position. Along the same lines, when the rigs are dismantled for transport, the guides must be removed from the upper and lower mast sections before the mast can be moved to the retracted position. Assembly and disassembly the guide is time consuming and thus costly.

A need exists for a guide for a top drive unit that requires no assembly and disassembly. It is to such a guide that the inventive concepts disclosed herein are directed.

DETAILED DESCRIPTION OF EXEMPLARY EMBODIMENTS

Figure 1:
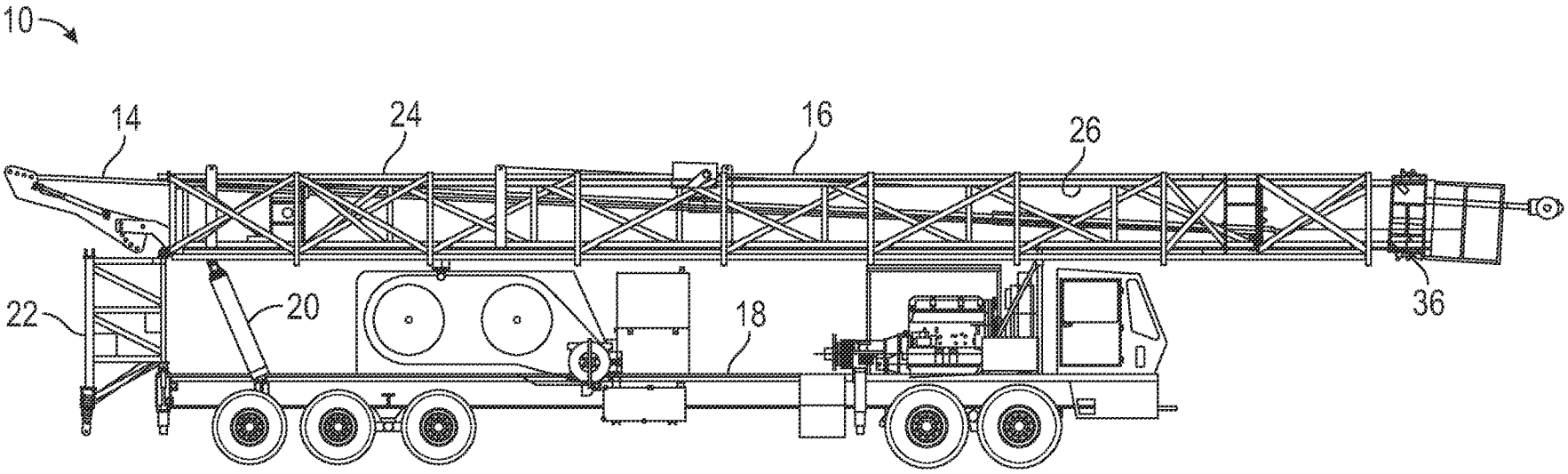
FIG. 1 is an elevational view of a rig assembly with a guide for a top drive unit constructed in accordance with the inventive concepts disclosed herein showing the rig assembly in a retracted, horizontal transport position.

The inventive concepts disclosed are generally directed to a guide for a top drive unit. The guide includes a lower track member, an upper track member, a slider, and a skate. The lower track member has a first end, a second end, and a lateral cross-sectional profile. The first end is pivotally connectable to a lower mast section of a rig assembly. The upper track member has a first end, a second end, and a lateral cross-sectional profile. The second end of the upper track member is pivotally connectable to an upper mast section of the rig assembly. The first end of the upper track member is received in the lower track member so the upper track member telescopes relative to the lower track member between a retracted position and an extended position. The slider has a first end, a second end, a lateral transverse profile extending from the first end toward the second end, and a laterally extending stop member spaced from the first end of the slider. The lateral cross-sectional profile of the slider is substantially the same size and shape as the lateral cross-sectional profile of the lower track member. The slider is slidably positioned about the upper track member so the slider is movable along the upper track member and the first end of the slider is mateable with the second end of the lower track member. The skate is slidably positioned about the lower track member to be movable along the lower track member from the first end, to the second end, and onto the slider when the first end of the slider is mated with the second end of the lower track member. When on the slider, the skate is engageable with the lateral stop member to cause the skate and the slider to move along the upper track member together. The skate is connectable to a top drive unit so the top drive unit is movable along the lower track member and the upper track member.

In another version, the inventive concepts disclosed are directed to a guide for a top drive unit in combination with a rig assembly having a base section, a lower mast section, and an upper mast section. The lower mast section is pivotally connected to the base section so the lower mast section and the upper mast section are movable between a substantially horizontal position and a substantially vertical position. The upper mast section is movable relative to the lower mast section between a retracted position and an extended position. The guide includes a lower track member, an upper track member, a slider, and a skate. The lower track member has a first end, a second end, and a lateral cross-sectional profile. The first end is pivotally connected to the lower mast section of the rig assembly. The upper track member has a first end, a second end, and a lateral cross-sectional profile. The second end of the upper track member is pivotally connected to the upper mast section of the rig assembly. The first end of the upper track member is received in the lower track member so the upper track member telescopes relative to the lower track member between a retracted position and an extended position. The slider has a first end, a second end, a lateral transverse profile extending from the first end toward the second end, and a laterally extending stop member spaced from the first end of the slider. The lateral cross-sectional profile of the slider is substantially the same size and shape as the lateral cross-sectional profile of the lower track member. The slider is slidably positioned about the upper track member so the slider is movable along the upper track member and the first end of the slider is mateable with the second end of the lower track member. The skate is slidably positioned about the lower track member to be movable along the lower track member from the first end, to the second end, and onto the slider when the first end of the slider is mated with the second end of the lower track member. When on the slider, the skate is engageable with the lateral stop member to cause the skate and the slider to move along the upper track member together. The skate is connectable to a top drive unit so the top drive unit is movable along the lower track member and the upper track member.

The inventive concepts are also directed to a rig assembly including a mast, a guide, and a top drive unit. The mast has a base section, a lower mast section, and an upper mast section. The lower mast section is pivotally connected to the base section so the lower mast section and the upper mast section are movable between a substantially horizontal position and a substantially vertical position. The upper mast section is movable relative to the lower mast section between a retracted position and an extended position. The guide includes a lower track member, an upper track member, a slider, and a skate. The lower track member has a first end, a second end, and a lateral cross-sectional profile. The first end is pivotally connected to the lower mast section of the rig assembly. The upper track member has a first end, a second end, and a lateral cross-sectional profile. The second end of the upper track member is pivotally connected to the upper mast section of the rig assembly. The first end of the upper track member is received in the lower track member so the upper track member telescopes relative to the lower track member between a retracted position and an extended position. The slider has a first end, a second end, a lateral transverse profile extending from the first end toward the second end, and a laterally extending stop member spaced from the first end of the slider. The lateral cross-sectional profile of the slider is substantially the same size and shape as the lateral cross-sectional profile of the lower track member. The slider is slidably positioned about the upper track member so the slider is movable along the upper track member and the first end of the slider is mateable with the second end of the lower track member. The skate is slidably positioned about the lower track member to be movable along the lower track member from the first end, to the second end, and onto the slider when the first end of the slider is mated with the second end of the lower track member. When on the slider, the skate is engageable with the lateral stop member to cause the skate and the slider to move along the upper track member together. The top drive unit is connected to the skate so the top drive unit is movable along the lower track member and the upper track member.

Before explaining at least one embodiment of the inventive concepts disclosed, it is to be understood that the inventive concepts are not limited in their application to the details of construction and the arrangement of the components or steps or methodologies in the following description or illustrated in the drawings. The inventive concepts disclosed are capable of other embodiments or of being practiced or carried out in various ways. Also, it is to be understood that the phraseology and terminology employed is for description only and should not be regarded as limiting the inventive concepts disclosed and claimed herein.

In this detailed description of embodiments of the inventive concepts, numerous specific details are set forth in order to provide a more thorough understanding of the inventive concepts. However, it will be apparent to one of ordinary skill in the art that the inventive concepts within the disclosure may be practiced without these specific details. In other instances, well-known features may not be described to avoid unnecessarily complicating the disclosure.

Further, unless stated to the contrary, "or" refers to an inclusive "or" and not to an exclusive "or." For example, a condition A or B is satisfied by anyone of: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concepts disclosed. This description should be read to include one or at least one and the singular also includes the plural unless it is obvious that it is meant otherwise.

As used herein any reference to "one embodiment" or "an embodiment" means that a particular element, feature, structure, or characteristic described in the embodiment is included in at least one embodiment. The appearances of the phrase "in one embodiment" in various places in the specification are not necessarily all referring to the same embodiment.

Figure 2:
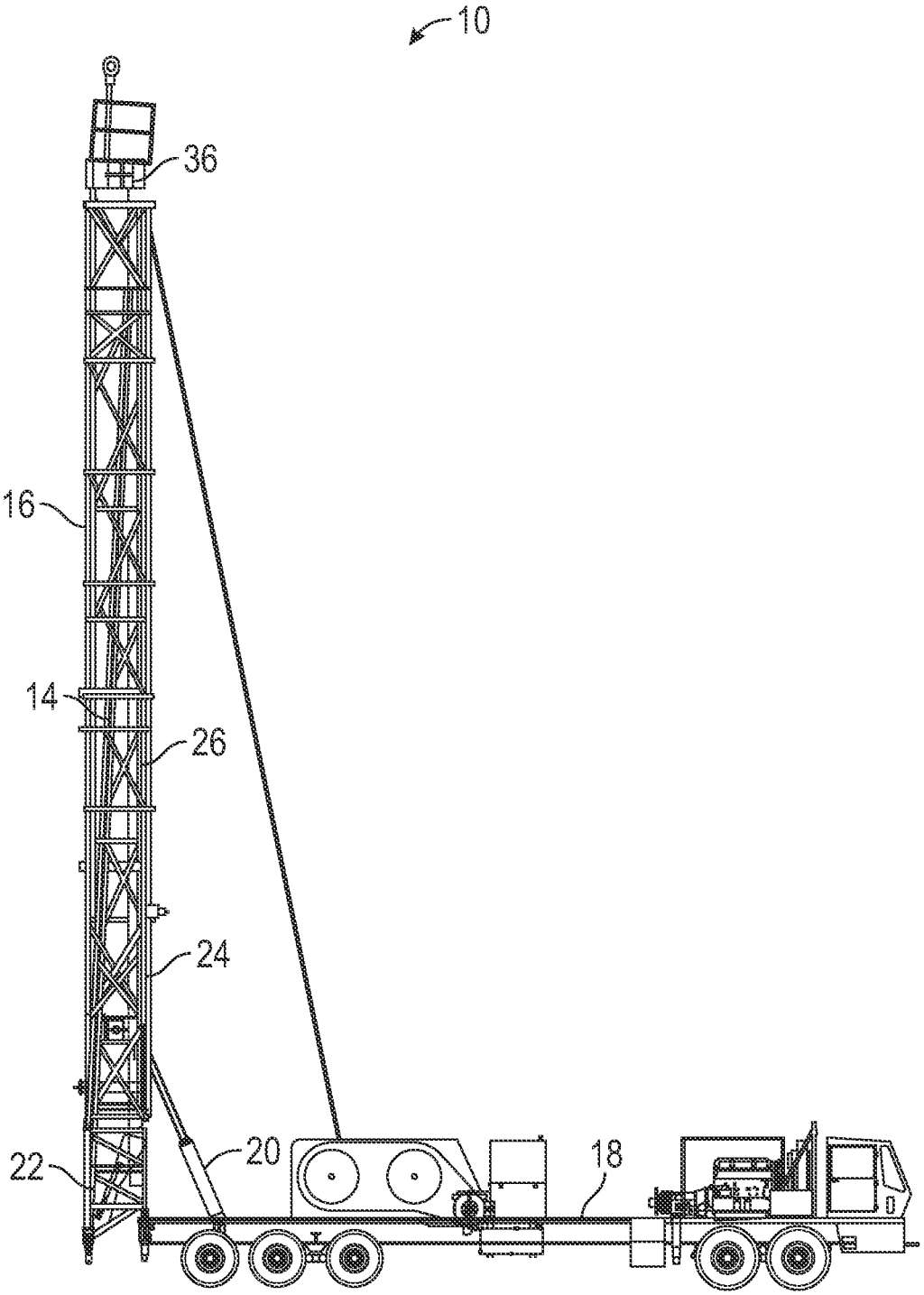
FIG. 2 is an elevational view of the rig assembly of FIG. 1 in a retracted, vertical position.
Figure 3:
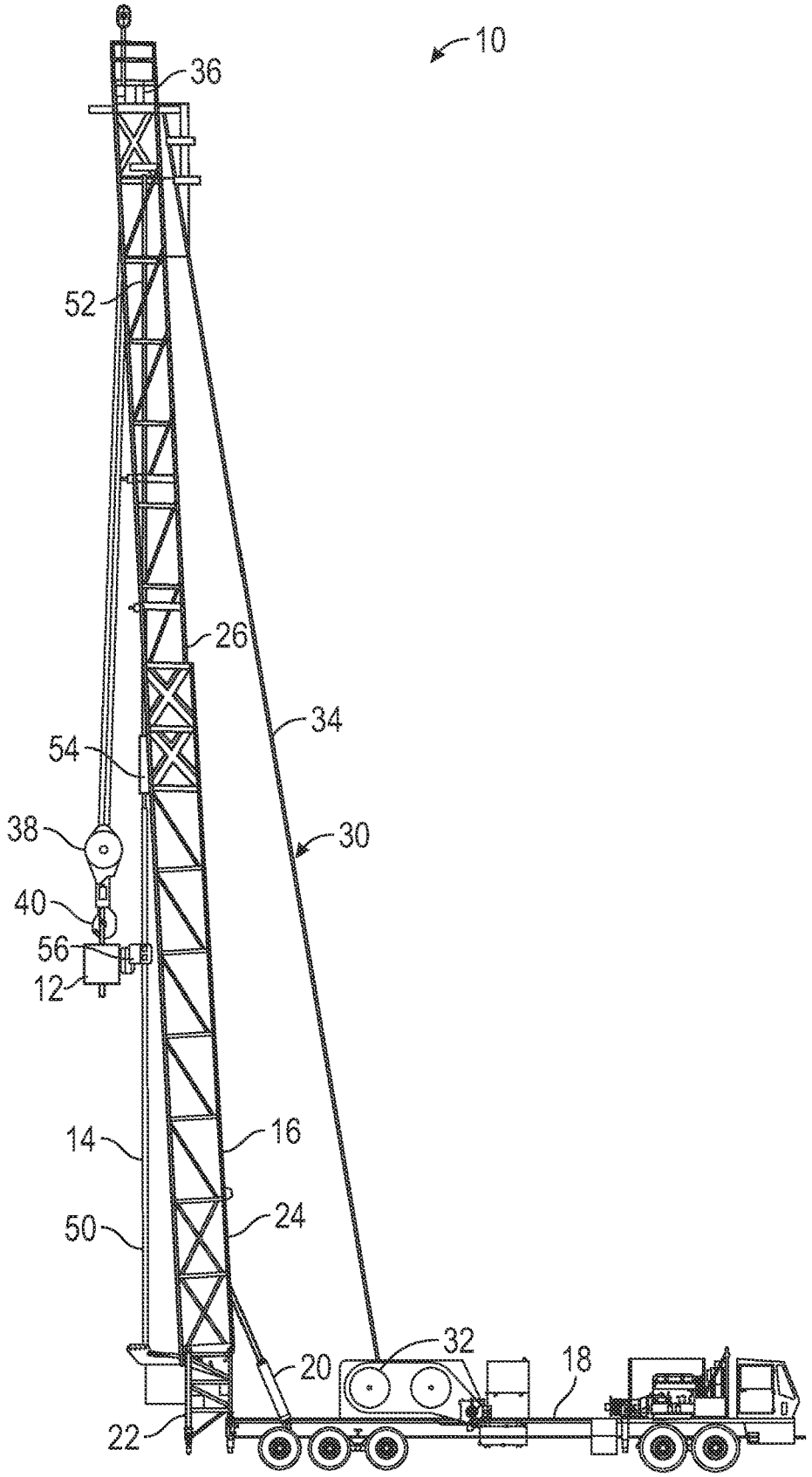
FIG. 3 is an elevational view of the rig assembly of FIG. 1 in an extended, vertical position.

Referring now to the drawings, and more particularly to FIGS. 1-3, a rig assembly 10 including a top drive unit 12 (diagrammatically illustrated in FIG. 3) and a guide 14 for the top drive unit 12 is illustrated. The rig assembly 10 is an example of a type of rig assembly known as a workover rig. The rig assembly 10 includes a mast or derrick 16 mounted on a carrier 18. A ram 20 may be used to raise the mast 16 to the position illustrated in FIGS. 2 and 3 and to lower the mast 16 back into a transport position on the carrier 18 illustrated in FIG. 1.

The mast 16 may include a base section 22, a lower mast section 24, and an upper mast section 26. The base section 22 is mounted to the carrier 18. The lower mast section 24 is pivotally connected to the base section 22 so the lower mast section 24 and the upper mast section 26 are movable between a substantially horizontal position for transport (FIG. 1) and a substantially vertical position (FIGS. 2 and 3) for well operations, such as drilling. The upper mast section 26 is telescopingly movable relative to the lower mast section 24 between a retracted position (FIGS. 1 and 2) and an extended position (FIG. 3). In one embodiment, the upper mast section 26 may be nested in the lower mast section 24 so the upper mast section 26 can be slidably coupled to the lower mast section 24. In one embodiment, each of the lower mast section 24 and the upper mast section 26 can be an open sided parallelepiped structure. The construction of the mast sections is conventional other than as described herein and need not be described in further detail.

The rig assembly 10 further includes a drawworks 30 for raising and lowering equipment up and down a borehole. The drawworks 30 may include a main drum 32, a cable 34 associated with the main drum 32. The cable 34 is anchored to the main drum 32 and extends through a crown block sheave 36 which may include one or more pulleys. From the crown block sheave 36, the cable 34 loops through a traveling block 38 provided with a hook 40. Operation of the main drum 32 causes the traveling block 38 and the hook 40 to raise and lower. The top drive unit 12 is suspended from the hook 40 and the drawworks 30 are operated to effect vertical movement of the top drive unit 12 along the guide 14.

The top drive unit 12 is used in assembling pipe strings, such as a drill string (not shown). The rig assembly 10 further a floor structure (not shown) at its lower end containing an opening through which the drill string extends downwardly into the earth to drill a well. The drill string is formed from a plurality of pipe sections interconnected at threaded joints and having a bit (not shown) at the lower end of the drill string. The drill string is driven rotatively by the top drive unit connected to the upper end of the drill string and is moved upwardly and downwardly along a vertical axis of the well. Numerous designs exist for top drive units. The top drive unit 12 is guided for vertical movement along the guide 14 in a manner to be discussed below.

Referring now to FIGS. 4-15, the guide 14 includes a lower track member 50, an upper track member 52, a slider 54, and a skate 56. The guide 14 is mounted in the mast 16 so the guide 14 extends and retracts with movement of the mast 16 between the retracted position (FIG. 1) and the extended positions (FIGS. 2 and 3) so the guide 14 requires no assembly or disassembly at a well site.

The lower track member 50 has a first end 58, a second end 60, and a lateral cross-sectional profile. The lower track member 50 is an elongated tubular member (FIG. 7) made of a suitable metal. In the embodiment illustrated herein, the lateral cross-sectional profile of the lower track member 50 is generally non-circularly shaped, such as square shaped. It will be appreciated, however, that other shapes may be used. The first end 58 of the lower track member 50 is pivotally connected to the lower mast section 24 with a lower mounting assembly 62.

Figure 5:
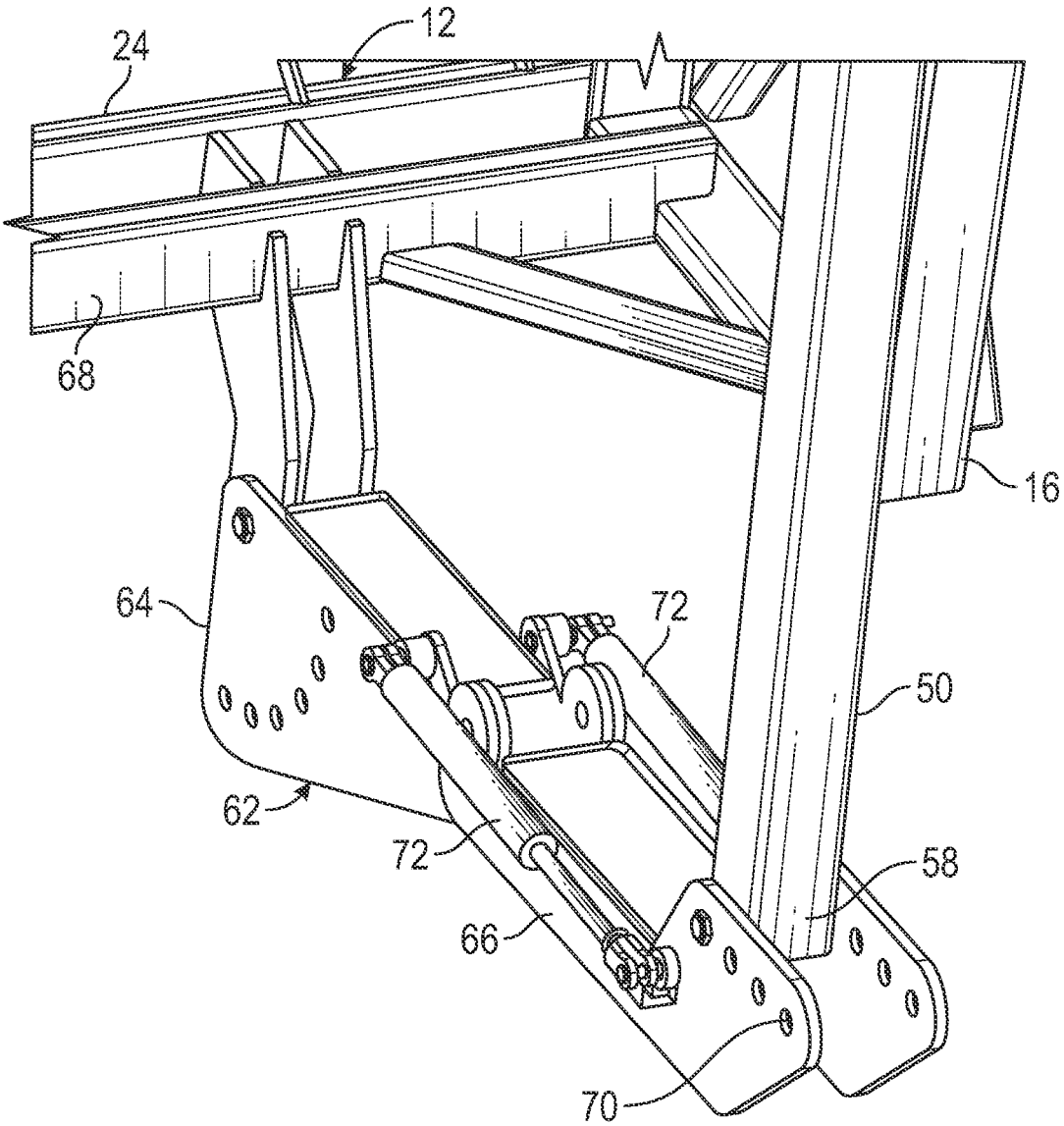
FIG. 5 is a perspective view of a lower mounting assembly shown connected to a lower mast section of the rig assembly.

In one embodiment, the lower mounting assembly 62 includes a base portion 64 and a mounting arm 66. The base portion 64 is connectable to the lower mast section 24 of the rig assembly 12. In one embodiment, the base portion 64 is connected to a cross beam 68 of the lower mast section 24, as best shown in FIG. 5. The base portion 64 may be connected to the lower mast section 24 in a suitable fashion, such as by welding or with fasteners. The mounting arm 66 has one end pivotally connected to the base portion 64 and another end pivotally connected to the first end 58 of the lower track member 50. The first end 58 of the lower track member 50 may be connected to the mounting arm 66 with a suitable pin. The mounting arm 66 may be provided a plurality of holes 70 to permit the position of the first end 58 of the lower track member to be laterally adjusted.

The mounting arm 66 is movable between a retracted position and an extended position. In one embodiment, in the retracted position the lower track member 50 is substantially parallel to the mounting arm 66 (FIGS. 1 and 2) and in the extended position the lower track member 50 is substantially perpendicular to the mounting arm 66 (FIG. 3). The lower mounting assembly 62 includes at least one actuator 72 positioned between the base portion 64 and the mounting arm 66 to move the mounting arm 66 between the retracted position and the extended position. The version of the mounting arm in FIG. 5 has two actuators 72.

Figure 6:
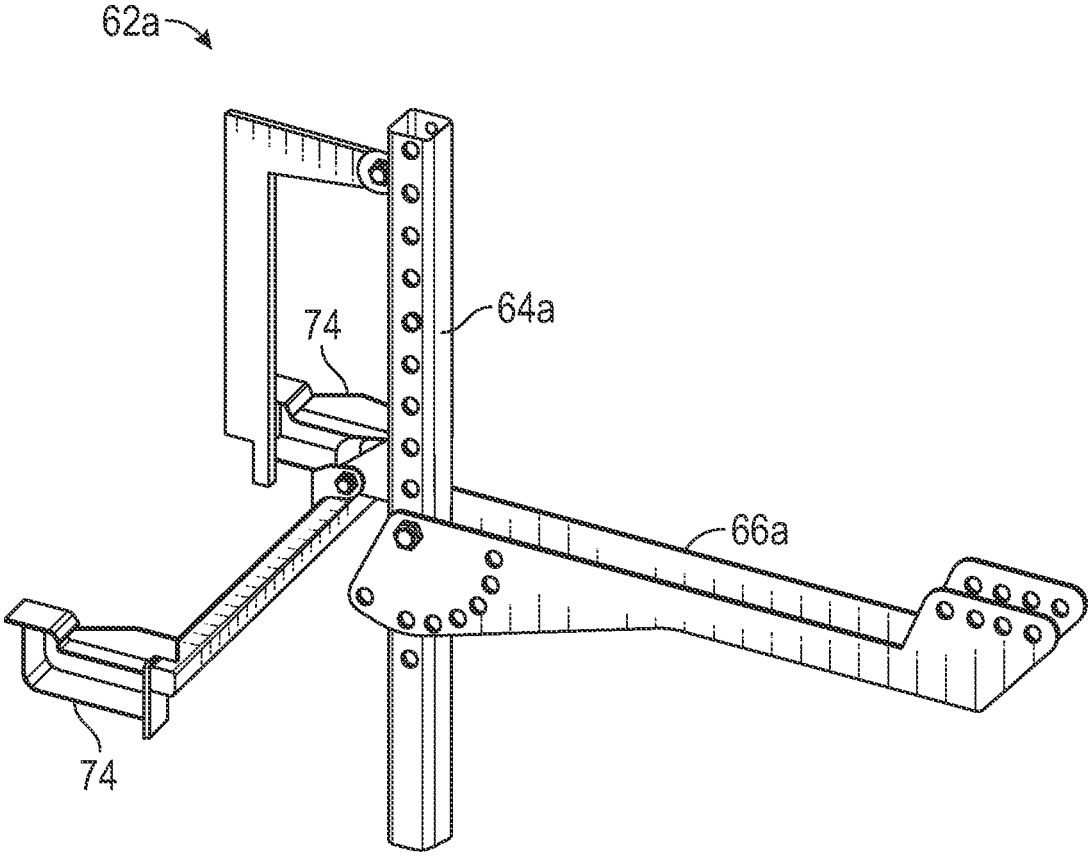
FIG. 6 is a perspective view of another embodiment of a lower mounting assembly.
Figure 7:
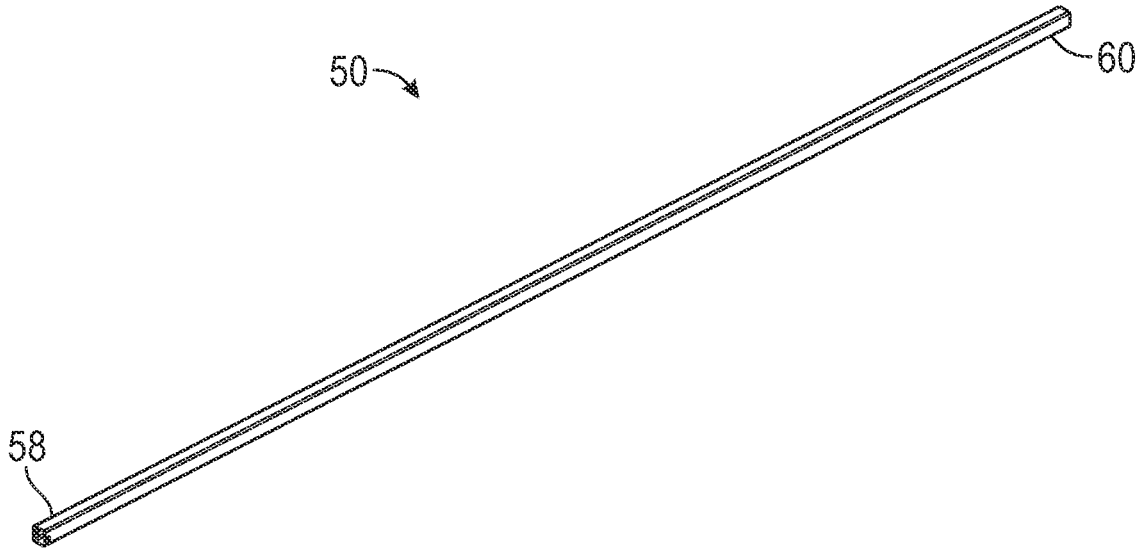
FIG. 7 is a perspective of a lower track member.

FIG. 6 illustrates another embodiment of a lower mounting assembly **62*a*. The lower mounting assembly 62*a* is similar to the lower mounting assembly 62, except the lower mounting assembly 62*a* has a mounting arm 66*a* pivotally connected to a base portion 64*a* in a way that the mounting arm 66*a* pivots freely relative to the base portion 62*a*. Also, the base portion 64*a* is shown to include a pair of clamp assembles 74 for connecting the lower mounting assembly 62*a* to the lower mast section 24**.

Figure 8:
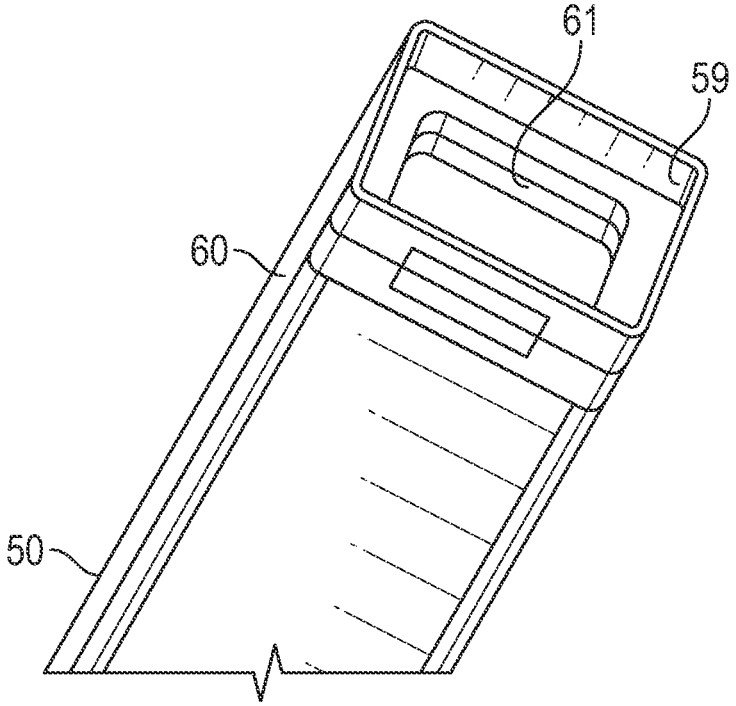
FIG. 8 is an enlarged, perspective view a second end of the lower track member.
Figure 9:
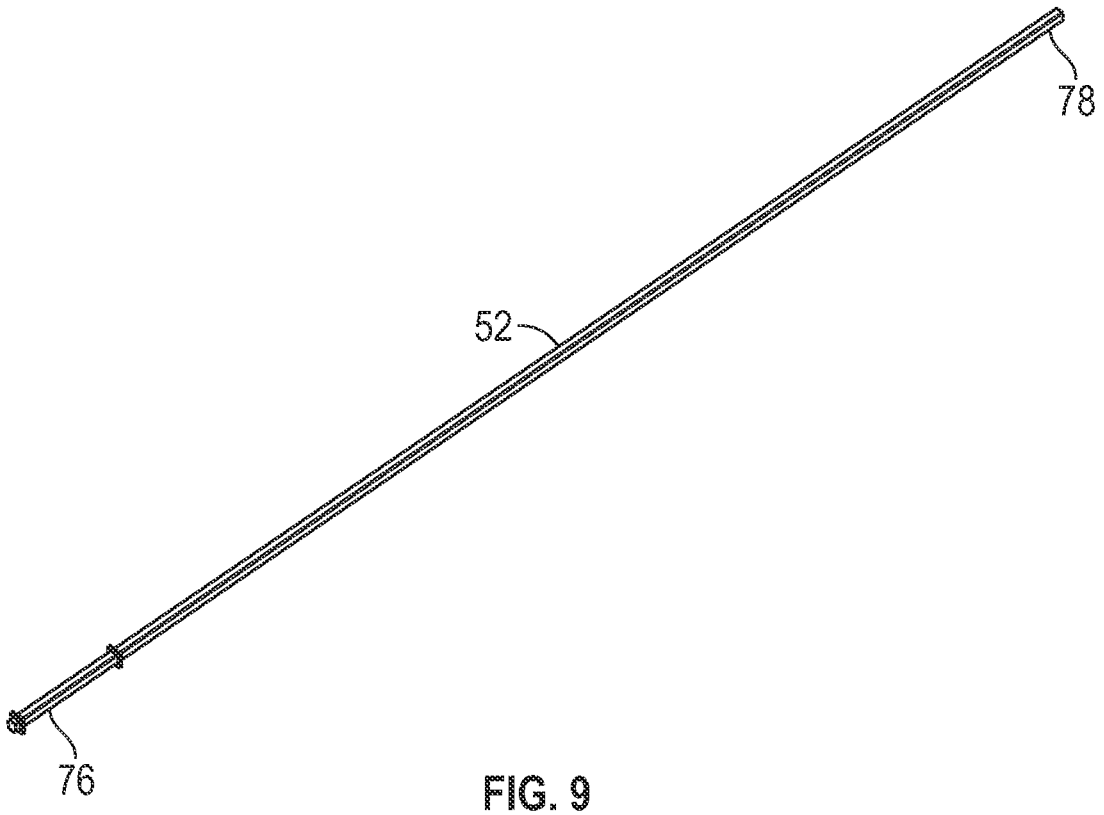
FIG. 9 is a perspective view of an upper track member.

Referring to FIG. 8, the second end 60 of the lower track member 50 has a recess 59 and an opening 61 sized to receive the upper track member 52.

Figure 4:
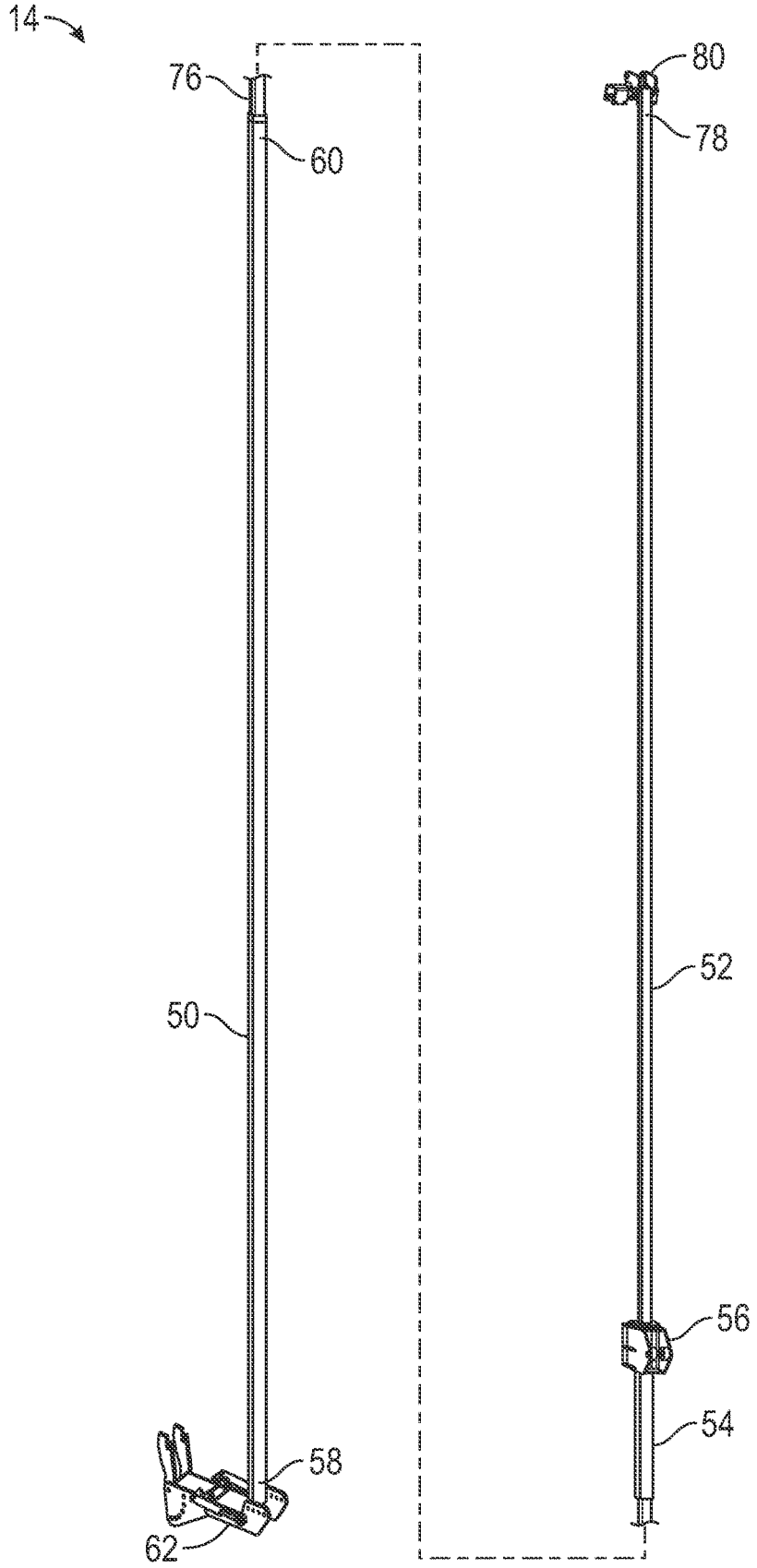
FIG. 4 is a perspective view of the guide constructed in accordance with the inventive concepts disclosed herein.

Referring to FIG. 9-12, the upper track member 52 has a first end 76, a second end 78, and a lateral cross-sectional profile. The upper track member 52 is an elongated tubular member made of a suitable metal. In the embodiment illustrated herein, the lateral cross-sectional profile of the upper track member 52 is generally non-circularly shaped, such as square shaped. It will be appreciated, however, that other shapes may be used. The first end 76 of the upper track member 52 is sized and shaped to be received in the second end 60 of the lower track member 50 so the upper track member 52 telescopes relative to the lower track member 50 between a retracted position (FIGS. 1 and 2) and an extended position (FIGS. 3 and 4). In one embodiment, the upper track member 52 is sized and shaped to be received in the opening 61 in the second end 60 of the lower track member 50.

Figure 10:
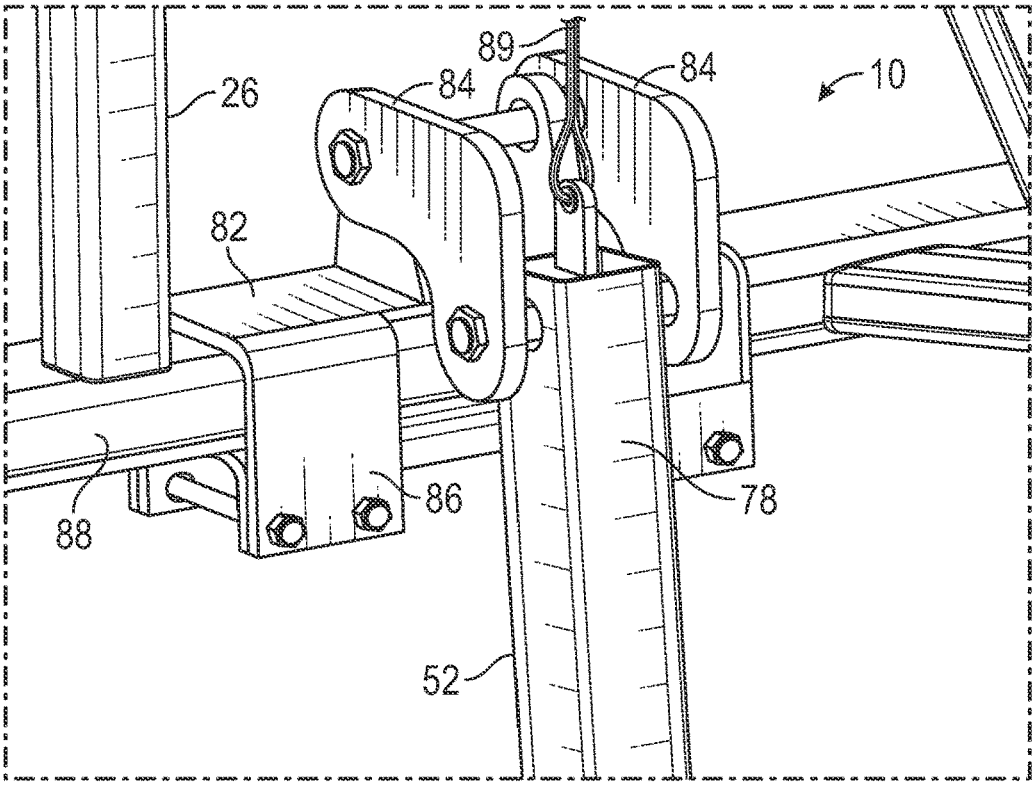
FIG. 10 is a perspective view of a second end of the upper track member shown connected to an upper mast section of the rig assembly with an upper mounting assembly.

The second end 78 of the upper track member 52 is pivotally connected to the upper mast section 26 with an upper mounting assembly 80 (FIGS. 4 and 10). In one embodiment, the upper mounting assembly 80 includes a base portion 82 and a mounting arm 84. In one embodiment, the upper mounting assembly 80 includes a pair of mounting arms 84. The base portion 82 is connectable to the upper mast section 26 of the rig assembly 10. In one embodiment, the base portion 82 includes a clamp assembly 86 connected to a cross beam 88 of the upper mast section 26, as best shown in FIG. 10. The base portion 82 may be connected to the upper mast section 26 in other ways, such as welding. The mounting arms 84 have one end pivotally connected to the base portion 82 and another end pivotally connected to the second end 78 of the upper track member 52. The upper track member 62 may also be connected to the upper mast section 26 with a cable 89 connected to a crown of the upper mast section 26.

Figure 11:
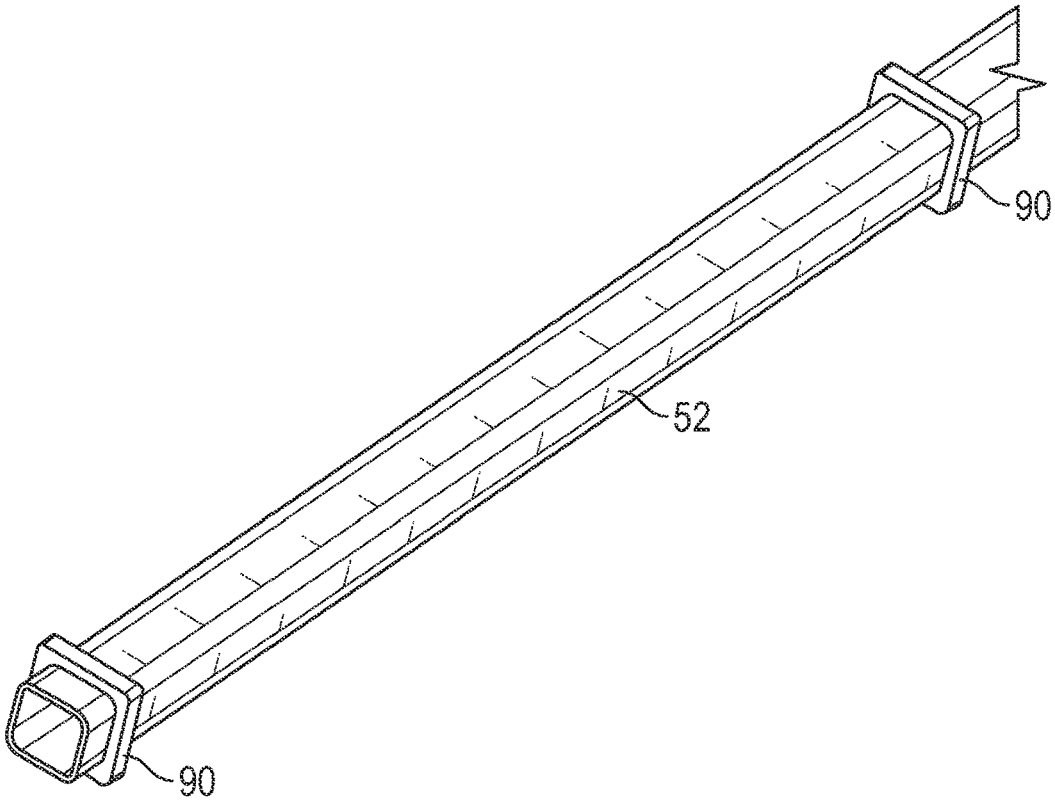
FIG. 11 is a perspective view of a first end of the upper track member.

Referring to FIG. 11, a lower portion of the upper track member 52 may be provided with stabilizers 90 to facilitate sliding engagement between the lower track member 50 and the upper track member 52. The stabilizers 90 are mounted to the portion of the upper track member disposed within the lower track member 50. The stabilizers 90 may be fabricated of a low friction material, such as nylon. In another embodiment, the stabilizers may be rollers or wheels.

The lower track member 50 and the upper track member 52 are connected to the rig mast 16 remotely from a well site with the upper track member 52 slidably disposed in the lower track member 50 so the guide 14 is not required to be assembled at the well site. Because the upper track member 52 is disposed in the lower track member 50, the cross-sectional profile of the upper track member 52 has a width less than a width of the lower track member 50. To create a track of uniform dimension from the first end 58 of the lower track member 50 to the second end 78 of the upper track member 52, the slider 54 is slidably positioned about the upper track member 52 so the slider 54 is movable along the upper track member 52.

Figure 12:
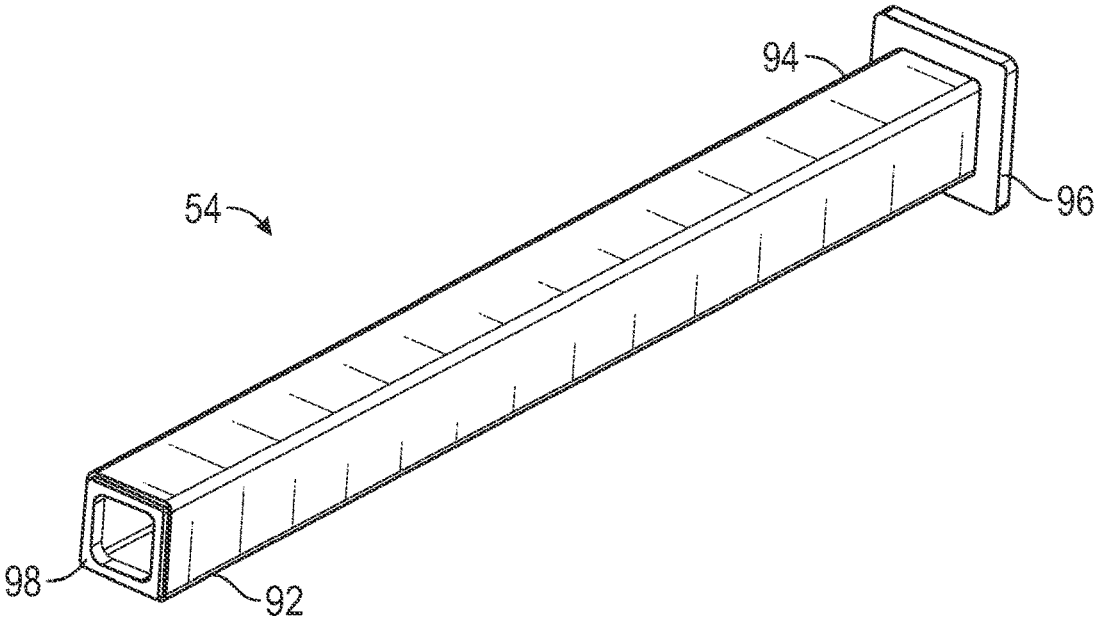
FIG. 12 is a perspective view of a slider.
Figure 13:
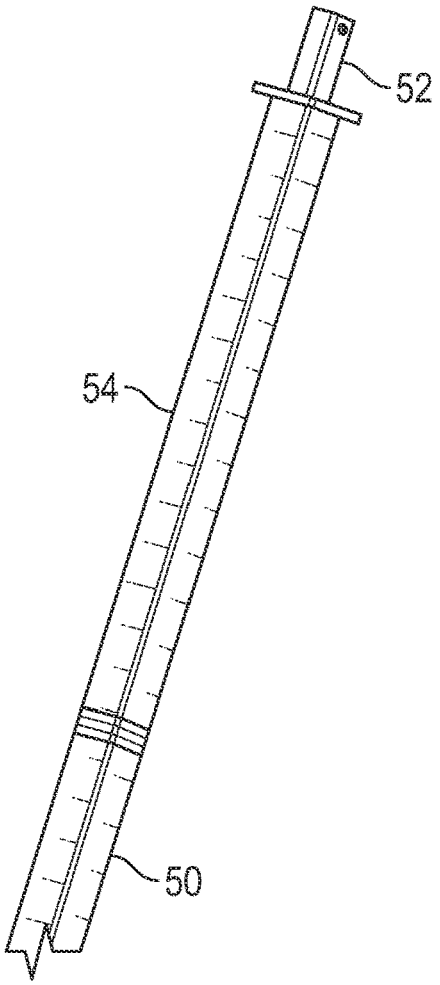
FIG. 13 is a perspective of the upper track member in a retracted position relative to the lower track member and the slider mated with the second end of the lower track member.

Referring to FIGS. 12 and 13, the slider 54 has a first end 92, a second end 94, a lateral transverse profile extending from the first end 92 toward the second end 94, and a laterally extending stop member 96 spaced from the first end 92 of the slider 54. The lateral cross-sectional profile of the slider 54 is the same size and shape as the lateral cross-sectional profile of the lower track member 50. The first end 92 of the slider 54 is mateable with the second end 60 of the lower track member 50. In one embodiment, the first end of the slider 54 has an annular protrusion 98 (FIG. 12) receivable in the recess 59 of the second end 60 of the lower track member 50 when the slider 54 is engaged with the lower track member 50, as shown in FIG. 13. The slider 54 may be provided a plurality of rails (not shown) fabricated of a low friction material, such as nylon, to facilitate movement of the slider 54 relative to the upper track member 52. In another embodiment, the slider 54 may be provided with rollers or wheels to facilitate movement.

Figure 14:
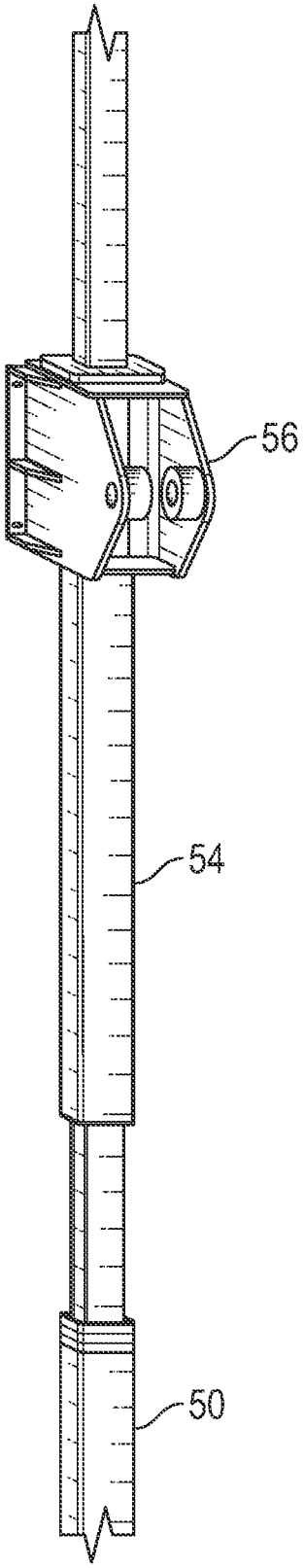
FIG. 14 is a perspective view of the upper track member in an extended position relative to the lower track member and a skate positioned about the slider with the slider disengaged from the second end of the lower track member.

Referring to FIG. 14, the skate 56 serves as the link between the top drive unit 12 (FIG. 3) and the lower track member 50 and the slider 54. The skate 56 is connectable to a top drive unit 12 so the top drive unit 12 is movable along the lower track member 50 and the upper track member 52. The skate 56 is slidably positioned about the lower track member 50 (FIG. 3) to be movable along the lower track member 50 from the first end 58, to the second end 60, and onto the slider 54 when the first end 92 of the slider 54 is mated with the second end 60 of the lower track member 50 (FIG. 13). When on the slider 54, the skate 56 is engageable with the lateral stop member 96 to cause the skate 56 and the slider 54 to move along the upper track member 52 together (FIG. 14).

Figure 15:
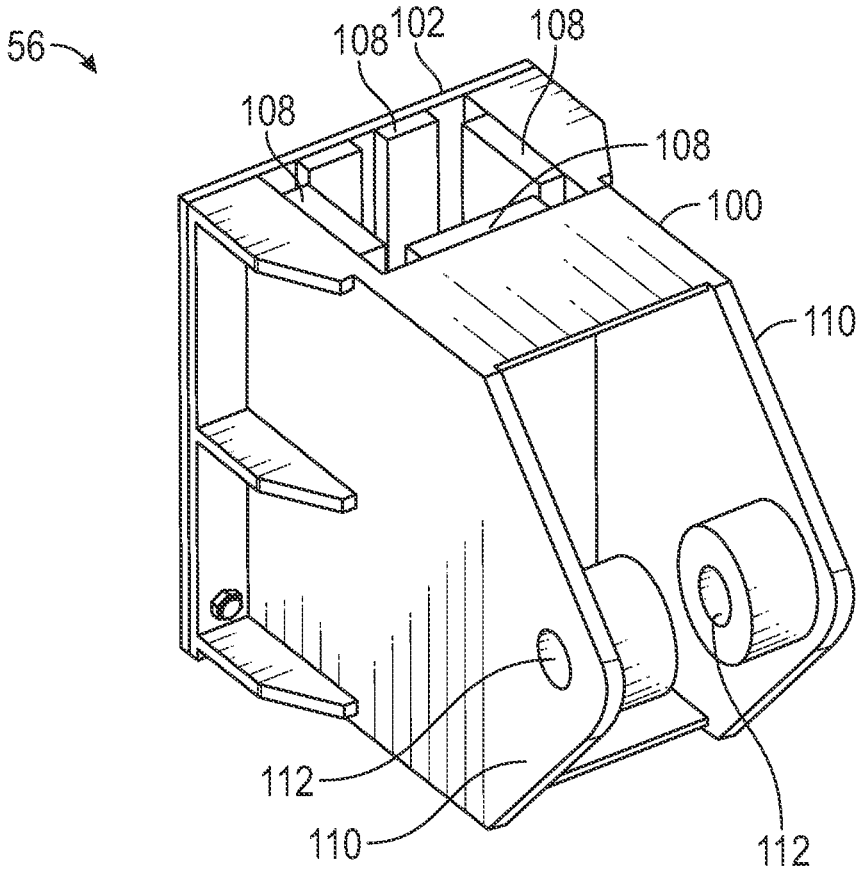
FIG. 15 is a perspective view of the skate.
Figure 16:
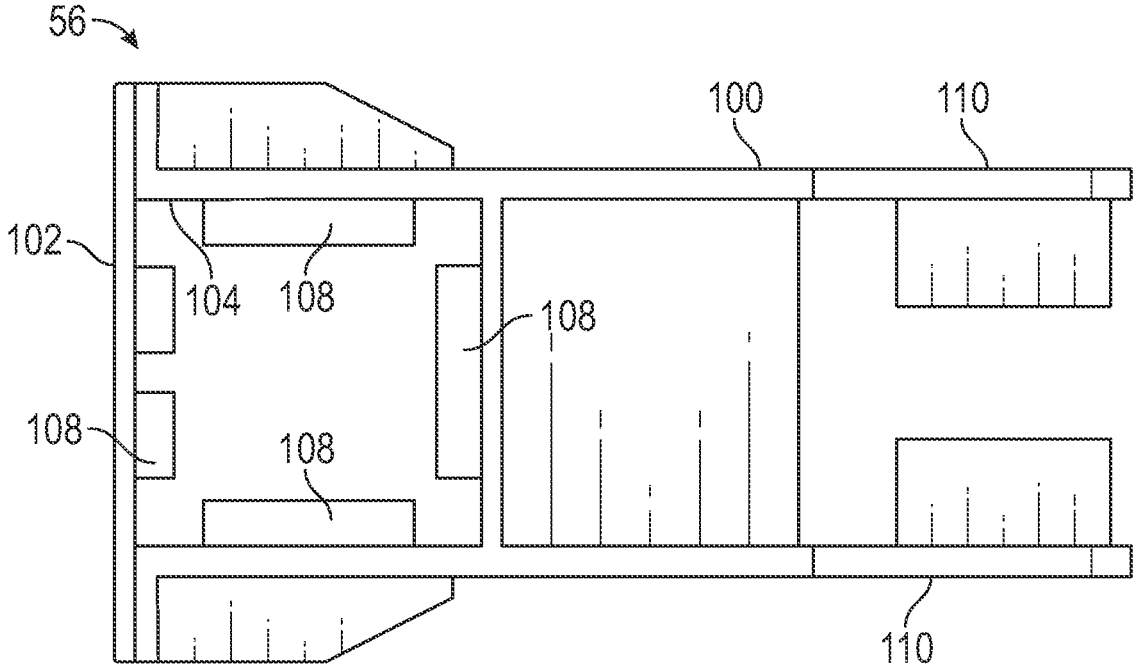
FIG. 16 is a bottom plan view of the skate of FIG. 15.

Referring to FIGS. 14-16, in one embodiment the skate 56 includes a body 100 and a cap 102. The body 100 and the cap 102 cooperate to define a passage 104 configured to receive the lower track member 50 and the slider 54. With the cap 102 removed from the body 100, the body 100 is positioned about the lower track member 50. The cap 102 is connected to the body 100 with suitable fasteners (not shown) to secure the skate 56 to the lower track member 50. The body 100 and the cap 102 may be provided with rails 108 along the length of the passage 104. The rails 108 may be fabricated of a low friction material to facilitate movement of the skate 56 along the lower track member 50 and the slider 54. In another embodiment, the skate 56 may be provided with rollers or wheels to facilitate movement.

The body 100 of the skate 56 has a pair of ears 110 with holes 112 aligned with one another. The holes 112 are configured to receive a complimentary portion of the top drive unit 12 so the top drive unit 12 may be connected to the skate 56.

In use, the rig assembly 10 is transported to a well site with the guide 14 mounted to the mast 16, as shown in FIG. 1. The upper track member 52 is in the retracted position relative to the lower track member 50 and the lower mounting assembly 62 is in the retracted position so at least a majority of the upper track member 52 and the lower track member 50 are positioned within the mast 16. At the well site, the mast 16 is erected by moving the upper mast section 26 and the lower mast section 24 to the vertical position, as shown in FIG. 2. The upper mast section 26 is then moved to the extended position in FIG. 3. As the upper mast section 26 is being extended, the upper track member 52 is extended relative to the lower track member 50. In the extended position, the lower mast section 24 and the upper mast section 26 are generally angled relative to vertical. The lower mounting assembly 62 is moved to the extended position to move the upper track member 52 and the lower track member 50 away from the mast 16 so the guide 14 is positioned in a substantially vertical orientation.

To operate the top drive unit 12, the top drive unit 12 is connected to the drawworks 30 to effect vertical movement along the guide 14. From the first end 58 of the lower track member 50, the top drive unit 12 is raised by the drawworks 30 causing the skate 56 to travel along the lower track member 50. As the top drive unit 14 is further raised, the skate 56 passes to the slider 54 and travels along the slider 54 until the skate 56 contacts the laterally extending stop member 96. Further raising of the top drive unit 14 causes the slider 54 to be unseated from the second end 60 of the lower track member 50 and travel upwardly along the upper track member 52 to a desired upward position.

On lowering the top drive unit 12, the slider 54 and the skate 56 travel downward along the upper track member 52 until the slider 54 engages the second end 60 of the lower track member 50. Further lowering of the top drive unit 14 causes the skate 56 to travel downwardly along the slider 54 and pass to the lower track member 50 along which the skate 56 travels to a desired lower position.

From the above description, it is clear that the inventive concepts disclosed herein is well adapted to carry out the objects and to attain the advantages mentioned and those inherent in the inventive concepts disclosed herein. While preferred embodiments of the inventive concepts disclosed have been described for this disclosure, it will be understood that numerous changes may be made which will readily suggest themselves to those skilled in the art and which are accomplished within the scope and coverage of the inventive concepts disclosed and claimed herein.

What is claimed is:

1. A method of forming a guide a top drive unit on a mast of a rig assembly, comprising:

pivotally connecting a lower track member to a lower mast section of the rig assembly, the lower track member having a first end, a second end, and a lateral cross-sectional profile;

slidably positioning a slider about an upper track member so the slider is movable along the upper track member, the upper track member having a first end, a second end, and a lateral cross-sectional profile, the slider having a first end, a second end, a lateral transverse profile extending from the first end toward the second end, and a laterally extending stop member spaced from the first end of the slider, the lateral cross-sectional profile of the slider being substantially the same shape and size as the lateral cross-sectional profile of the lower track member, the first end of the slider being mateable with the second end of the lower track member inserting the first end of an upper track member in the second end of the lower track member so the upper track member telescopes relative to the lower track member between a retracted position and an extended position;

pivotally connecting the second end of the upper track member to an upper mast section of the rig assembly;

slidably positioning a skate about the lower track member to be movable along the lower track member from the first end, to the second end, and onto the slider when the first end of the slider is mated with the second end of the lower track member, when on the slider the skate is engageable with the lateral stop member to cause the skate and the slider to move along the upper track member together; and connecting the top drive unit to the skate so the top drive unit is movable along the lower track member and the upper track member.

2. The method of claim 1, wherein the lateral cross-sectional profile of the lower track member, the upper track, and the slider is non-circularly shaped.

3. The method of claim 2, wherein the lateral cross-sectional profile of the lower track member, the upper track member, and the slider is square shaped.

4. The method of claim 1, further comprising moving the first end of the lower track member away from the lower mast section so the so the lower track member and the upper track member are positioned in a substantially vertical orientation when the mast is in the substantially vertical position.

5. The method of claim 1, wherein the rig assembly further comprises a drawworks and a traveling block and hook connected to the drawworks, and wherein the method further comprises connecting the hook to the top drive unit and operating the drawworks to move the top drive unit along the lower track member and the upper track member.

6. A method of forming a guide for a top drive unit on a rig assembly, comprising:

transporting the rig assembly to a well site with a top drive guide mounted to a mast of the rig assembly, wherein the mast comprises a base section, a lower mast section, and an upper mast section, the lower mast section pivotally connected to the base section so the lower mast section and the upper mast section are movable between a substantially horizontal position and a substantially vertical position, the upper mast section being movable relative to the lower mast section between a retracted position and an extended position, wherein the top drive guide comprises:

a lower track member having a first end, a second end, and a lateral cross-sectional profile, the first end pivotally connected to the lower mast section;

an upper track member having a first end, a second end, and a lateral cross-sectional profile, the second end of the upper track member pivotally connected to the upper mast section, the first end of the upper track member received in the lower track member so the upper track member telescopes relative to the lower track member between a retracted position and an extended position;

a slider having a first end, a second end, a lateral transverse profile extending from the first end toward the second end, and a laterally extending stop member spaced from the first end of the slider, the lateral cross-sectional profile of the slider being substantially the same shape and size as the lateral cross-sectional profile of the lower track member, the slider slidably positioned about the upper track member so the slider is movable along the upper track member, the first end of the slider being mateable with the second end of the lower track member; and a skate slidably positioned about the lower track member to be movable along the lower track member from the first end, to the second end, and onto the slider when the first end of the slider is mated with the second end of the lower track member, when on the slider the skate is engageable with the lateral stop member to cause the skate and the slider to move along the upper track member together;

moving the mast from the substantially horizontal position to a substantially vertical position;

moving the upper mast section from the retracted position of the mast to the extended position of the mast so the upper track member telescopes relative to the lower track member from the retracted position of the top drive guide to the extended position of the top drive guide; and connecting a top drive unit to the skate so the top drive unit is movable along the lower track member and the upper track member of the top drive guide.

7. The method of claim 6, wherein the lateral cross-sectional profile of the lower track member, the upper track, and the slider is non-circularly shaped.

8. The Method of claim 7, wherein the lateral cross-sectional profile of the lower track member, the upper track member, and the slider is square shaped.

9. The method of claim 6, further comprising moving the first end of the lower track member away from the lower mast section so the so the lower track member and the upper track member are positioned in a substantially vertical orientation when the mast is in the substantially vertical position.

10. The method of claim 6, wherein the rig assembly further comprises a drawworks and a traveling block and hook connected to the drawworks, and wherein the method further comprises connecting the hook to the top drive unit and operating the drawworks to move the top drive unit along the lower track member and the upper track member.

* * * * *